United States Patent [19]

McDonald

[11] 4,456,254

[45] Jun. 26, 1984

[54] APPARATUS FOR STRINGING A RACQUET

[76] Inventor: Ernest McDonald, 18701 Walkers Choice Rd., Apt. #5, Gaithersburg, Md. 20879

[21] Appl. No.: 547,490

[22] Filed: Nov. 1, 1983

Related U.S. Application Data

[62] Division of Ser. No. 428,814, Sep. 30, 1982, Pat. No. 4,439,908.

[51] Int. Cl.[3] ..... A63B 51/14

[52] U.S. Cl. ..... 273/73 A; 29/446

[58] Field of Search ..... 273/73 A, 73 B; 29/446, 29/448; 87/24, 3

[56] References Cited

U.S. PATENT DOCUMENTS 2,188,250 1/1940 Serrano ..... 273/73 A 4,149,722 4/1979 Yager ..... 273/73 A 4,163,553 8/1979 Renfro ..... 273/73 A

FOREIGN PATENT DOCUMENTS 3127 of 1885 United Kingdom ..... 273/73 A

*Primary Examiner*—Richard C. Pinkham

*Assistant Examiner*—Matthew L. Schneider

*Attorney, Agent, or Firm*—Paul L. Hickman

[57] ABSTRACT

An apparatus for tensioning a pre-strung web onto a racket characterized by an elongated base supporting a pair of carriages for reciprocal, colinear movement. A plurality of stretcher bars are supported by the base between the carriages to stretch the web row-by-row away from a central axis. Links are provided to selectively couple the stretcher bars to the carriages.

7 Claims, 10 Drawing Figures

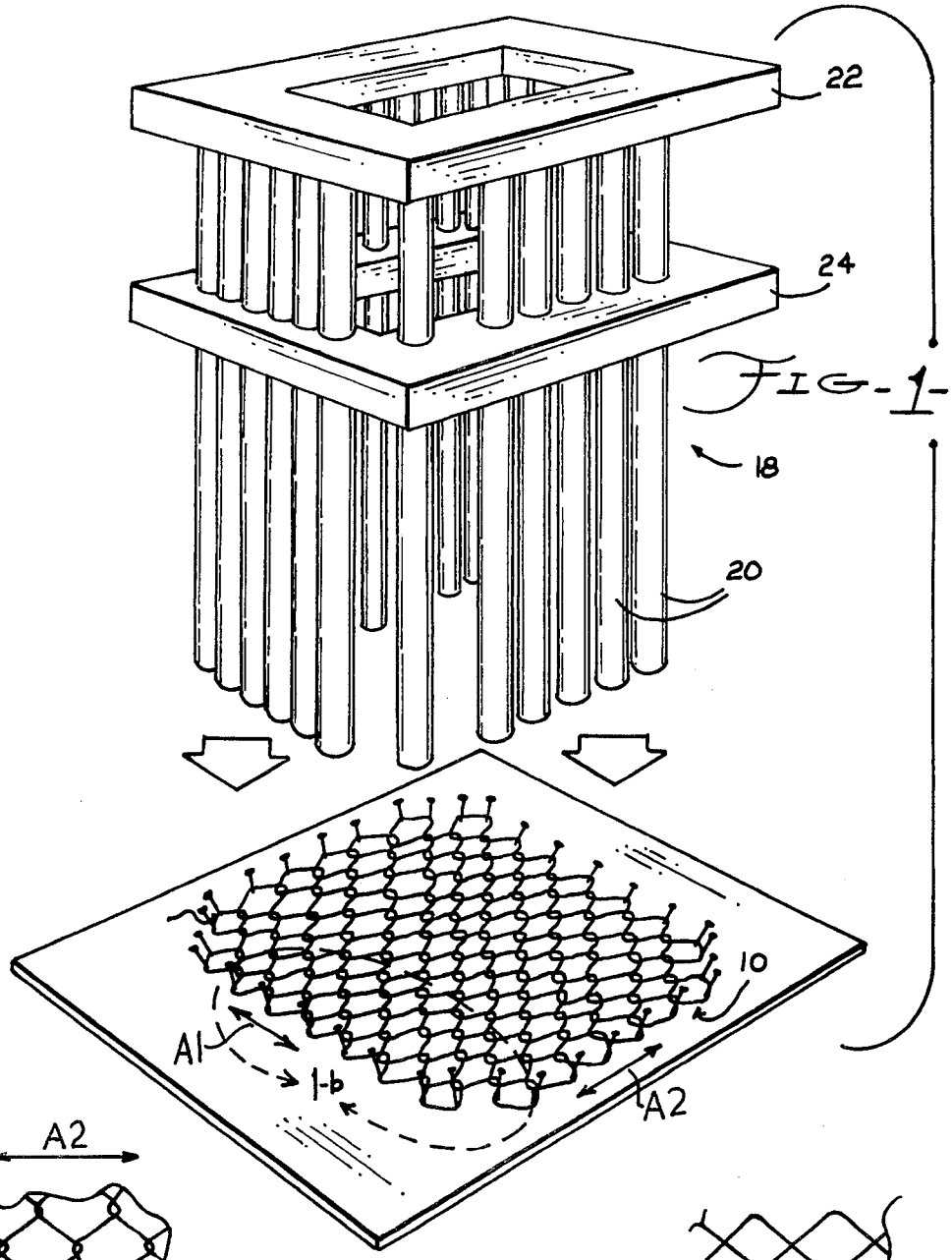
FIG-1-a-
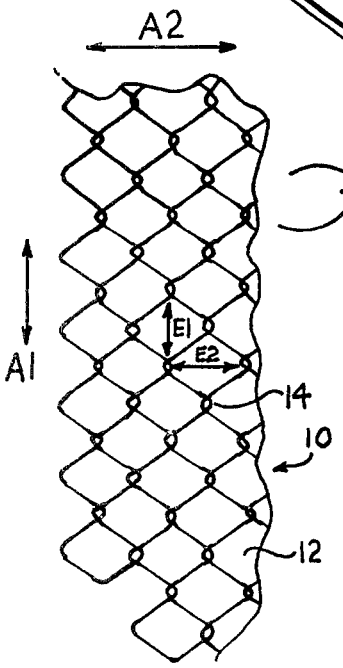
FIG-1-b-
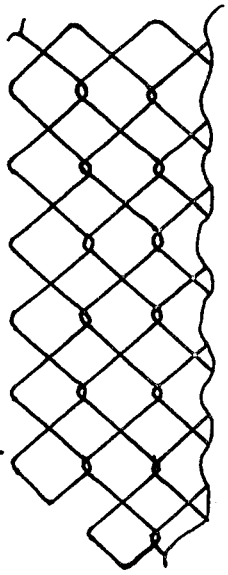
FIG-1-c-

APPARATUS FOR STRINGING A RACQUET

This application is a division of application Ser. No. 428,814, filed Sept. 30, 1982, now U.S. Pat. No. 4,439,908.

BACKGROUND OF THE INVENTION

1. Field of the Invention

This invention relates generally to sports equipment and more particularly to methods and apparatus for stringing a racquet.

2. Description of the Prior Art

Racquets are used in a number of popular games including tennis, badminton, racquetball, and squash. A racquet typically includes an elongated handle, a generally elliptically shaped head attached to one end of the handle, and a network of string stretched across the racquet head.

While there are many ways to string a racquet, by far the most common method is the so called "basket weave". To string a racquet with a basket weave a long segment of string is woven back and forth across the racquet head to form a warp. The string is then woven though the warp in an over and under pattern to form a weft.

Traditional stringing methods are time consuming processes and require trained technicians in their implementation. These factors add to the cost of stringing a racquet.

A problem with the basket weave string pattern for racquets is that the rebound characteristics are not constant across the entire face of the racquet. The so called "sweet spot" where the maximum ball rebound occurs is a relatively small area located near the center of the basket weave string pattern. Areas farther from the center of the string pattern are far less rebound efficient.

Another disadvantage of the basket weave is that the strings are tensioned by pulling on an end portion of the string, causing an uneven tensioning of the string across the face of the racquet. In order to insure a certain minimum tension along the length of the string, portions of the string may be over tensioned, reducing the useful life of the string.

Yet another disadvantage of the basket weave stringing pattern is that the warp and weft string segments saw against each other each time a ball is hit. This again leads to premature wear and breakage of the strings.

Due to the above mentioned disadvantages of the basket weave a number of alternative racquets stringing methods have been devised. Most notable among these are the chain link stringing methods exemplified in British Pat. No. 3,127 of Baden-Powell, U.S. Pat. No. 4,163,553 of Renfro, and U.S. Pat. No. 4,149,722 of Yager.

In 1885, Baden-Powell devised a string pattern made by "looping" a single continuous string through itself in a manner of a knitted fabric. The "knitting" of the string is performed on a board having removable pegs fitted in holes corresponding to the points of intersection of the lines of stringing. After the string has been "knitted" together, it is laced to the head of a racquet.

In the Renfro patent, a tennis racquet head is strung with string sections formed into zig-zag segments having multiple junction points. Renfro's method includes clamping the racquet head to a peg board and weaving the zig-zag pattern directly onto the racquet head. Each of the zig-zag strings is tensioned by pulling on its end.

Yager's patent is directed to a preformed racquet string comprising a loosely woven network of string woven into a substantially oval shaped pre-string. The pre-string is woven in non-parallel rows such that it is radially expansible. The pre-string is stretched from its periphery and then laced or latched to a racquet head. Since the pre-string is not formed in parallel rows, it is not linearly expansible.

While the pre-strings and stringing methods cited above may be an improvement over the basket weave stringing method, some problems remain unsolved. For example, in the Renfro method the strings are still tensioned one at a time by pulling on their ends as they are laced to the racquet head. In the Baden-Powell and Yager patents, pre-strings are laced to the racquet head by applying a radial tensioning force to perimeter of the pre-strings. This results in a racquet face with a higher tension near the perimeter of the pre-strings than near its center.

SUMMARY OF THE INVENTION

An object of this invention is to provide a superior racquet stringing method.

Another object of this invention is to provide a racquet stringing method which allows a racquet to be quickly strung.

Another object of this invention is to provide a method for stringing a racquet that is easily learned, and one which does not require a trained technician.

Yet another object of this invention is to provide an expansible pre-strung web adapted to be tensioned row-by-row from the inside outward to insure a uniform tensioning of the strings.

A still further object of this invention is to provide a stringing machine particularly adapted to perform the method of this invention.

Briefly, the method for stringing a racquet in accordance with the present invention begins with preparing a pre-strung web having a linear axis of expansion and a central axis substantially perpendicular to the axis of expansion. The web comprises string means woven into a number of parallel, interlocking, zig-zag rows such that the interstices of the web are diamond shaped and have a longitudinal axis parallel to the linear axis of expansion of the web. Successive rows of the pre-strung web are spread apart (either singly or in pairs) along the axis of expansion beginning with the central rows and proceeding outwardly to the outermost rows to tension the entire web face. Finally, the perimeter of the pre-strung web is attached to the racquet.

An apparatus particularly adapted to attach the pre-strung web of the present invention to the head of a racquet includes a base, and a pair of carriages supported by the base for movement along a linear track. The apparatus also includes screw means for incrementally moving the first carriage and the second carriage towards and away from each other, and a plurality of expansion bars supported by the base between the two carriages. The expansion bars are provided with a number of upwardly extending pins adapted to engage and spread the apexes of the diamond shaped interstices of the pre-strung web. Means are provided to couple selective expansion bars to the carriages such that the rows of the pre-strung web can be stretched by separating the two carriages.

An advantage of the method of this invention is that the pre-strung web can be stretched row-by-row from the center out to provide substantially constant tension over the entire stringing surface.

An advantage of the apparatus of the present invention is that a pre-strung web may be quickly and efficiently attached to the head of a racquet by personnel having a minimum of training.

Other advantages of the present invention is that a strung racquet is produced that is more desirable, has a larger "sweet spot", and which gives better performance. Furthermore, the method and apparatus of this invention can produce a strung racquet that is cosmetically pleasing.

These and other objects and advantages of the present invention will no doubt become apparent upon a reading of the following descriptions and a study of the several Figures of the drawing.

BRIEF DESCRIPTION OF THE DRAWING

FIG. 1*a* is a perspective view of a pre-strung web used with the present invention along with a apparatus for preparing the web and an apparatus for transporting the web to the web stretching machine.

FIG. 1*b* is an enlarged view of the portion of the pre-strung web encircled by line 1B in FIG. 1*a*.

FIG. 1*c* is an enlarged view of an alternate pattern for the pre-strung web.

DETAILED DESCRIPTION OF THE PREFERRED EMBODIMENT(S)

Figure 2:
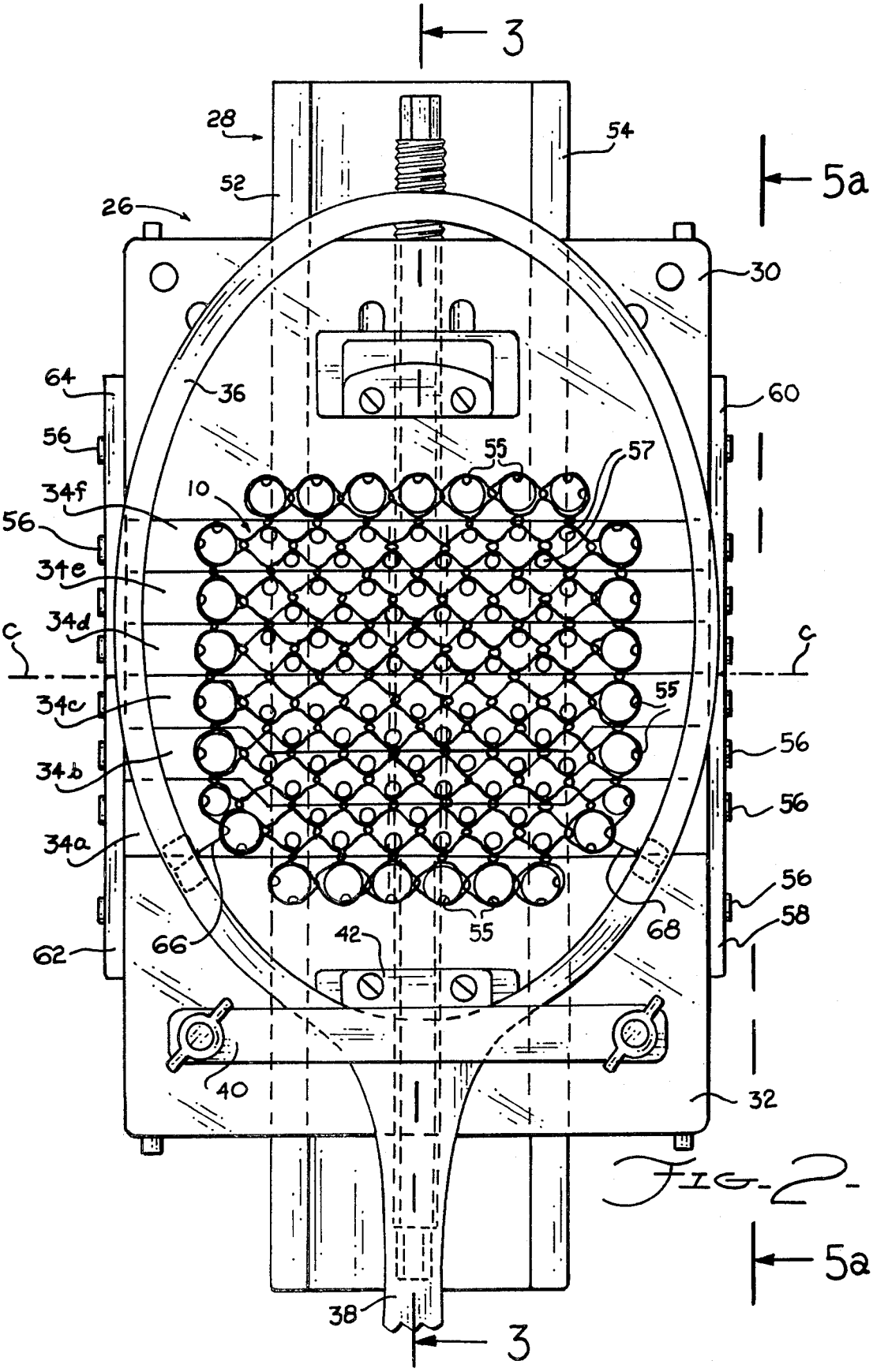
FIG. 2 is a top plan view of an unstrung tennis racquet clamped to a web stretching apparatus of the present invention.

Referring to FIGS. 1*a* and 1*b*, an expansible pre-strung web 10 in accordance with the present invention includes a number of parallel, interlocking, zig-zag rows chain linked together to form diamond-shaped interstices 12. Preferably, the web is formed from a continuous length of natural or synthetic racquet string.

Referring more particularly to FIG. 1*b*, each of the interstices 12 are substantially diamond shaped with apexes 14 interlocking with apexes of an adjoining row. The apexes 14 of the interstices are aligned into columns and rows which are parallel to a pair of expansion axes $A_1$ and $A_2$ of the web. The expansible web 10 may be expanded along axis $A_1$ to elongate first axes $E_1$ of the interstices 12, or the web may be expanded along axis $A_2$ to expand the second axes of $E_2$ of interstices. Of course, stretching along axis $A_1$ will create tension along axis $A_2$, and vice versa. In one embodiment of this invention the web may be expanded along both axis $A_1$ and axis $A_2$ to concurrently stretch axes $E_1$ and $E_2$. No matter what stretching method is used, however, it is important that the apexes 14 of interstices 12 align with the axis $A_1$ and/or $A_2$ along which the web is to be stretched.

In FIG. 1*c* an alternate embodiment of a pre-strung web is shown which has rows which alternate between chain-link and basket weave. The apexes of the chain-linked rows are still aligned with columns parallel to a linear axis of expansion. Any number of web patterns may be used with the method and apparatus of this innvention as long as the chain-linked rows are aligned and capable of this linear expansion row-by-row.

Referring again to FIG. 1*a*, one apparatus for producing a web 10 is a peg board 16 having a number of removable pins 18. The interlocking, zig-zag rows are made perpendicular and parallel to axes $A_1$ and $A_2$, respectively. A preferred method for preparing the pre-strung web is suggested in FIG. 1*a* wherein a single, long segment of string is strung back and forth in interlocking, zig-zag rows.

One or more finished pre-strung webs 10 can be stored on a web carrier 18 comprising a number of posts 20 attached to upper and lower post supports 22 and 24. Posts 20 engage at least some of the interstices around the perimeter of the pre-strung web and provide a convenient means of storing and installing the web to the web stretching apparatus of the present invention.

Referring now to FIG. 2, a web stretching machine 26 in accordance with the present invention includes an elongated channel shaped base 28, a first movable carriage 30, a second movable carriage 32, and a number of expansion bars 34*a*–34*f*. The head 36 of a tennis racquet 38 is clamped to carriage 32 by a clamp assembly 40 and prevented from longitudinal movement by a stop member 42. The opposing end of racquet head 36 is unclamped at this time.

Figures 3, 4:
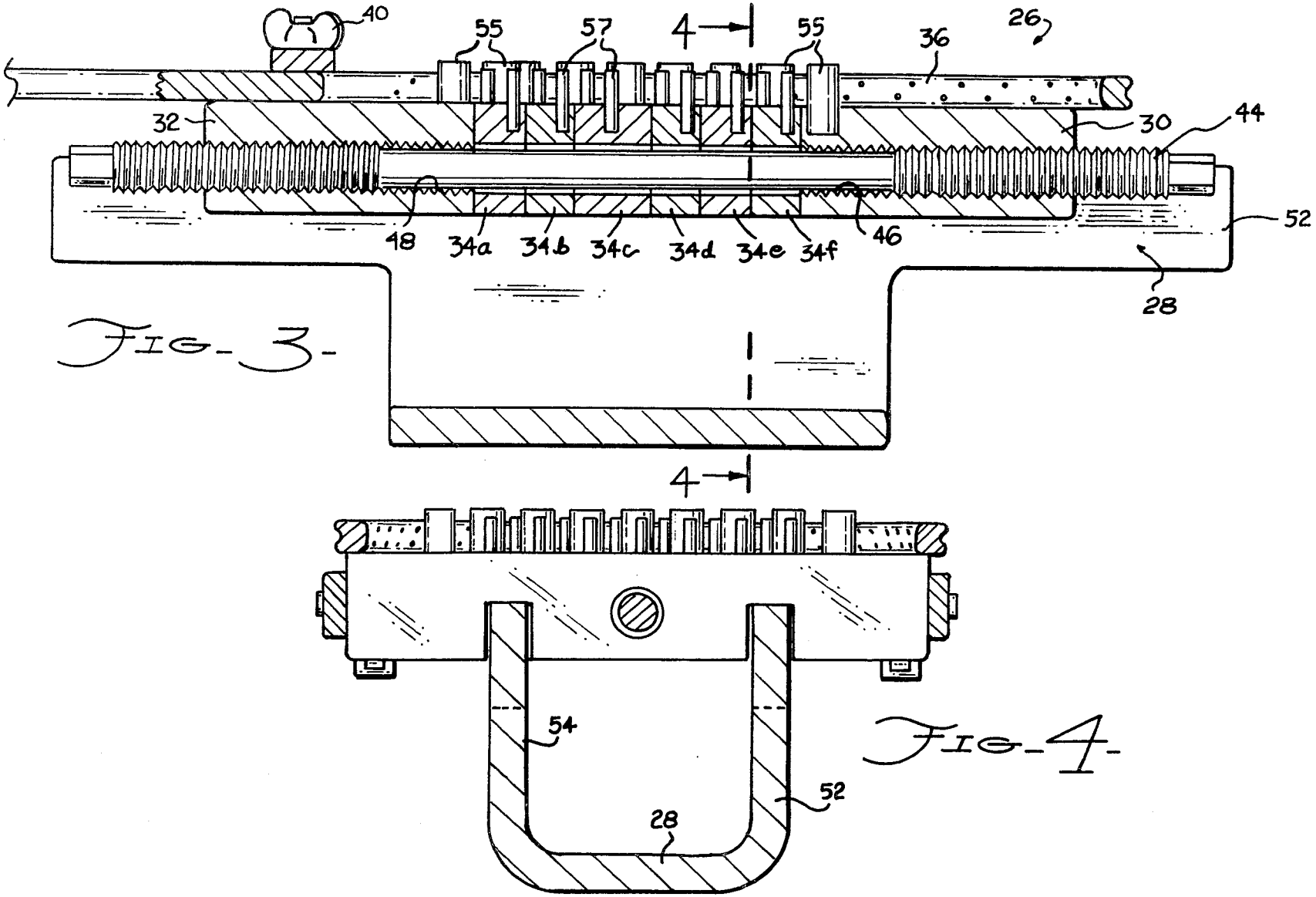
FIG. 3 is a longitudinal cross-section section taken along line 3—3 of FIG. 2.
FIG. 4 is a transverse cross-section taken along line 4—4 of FIG. 3.

Referring additionally to FIGS. 3 and 4, an elongated screw 44 engages threaded bores 46 and 48 of carriages 30 and 32, respectively. Bores 46 and 48 are opposingly threaded, as are the two ends of screw 44. Thus, rotation of screw 44 causes the carriages 30 and 32 to move in opposite directions. The two carriages slide along a track comprising sidewall portions 52 and 54 of channel shaped base 28. Expansion bars 34*a*–*f* similarly slide along portions 52 and 54 but, as shown in the FIG. 3, do not engage screw 44.

Referring now to FIGS. 2–4, expansion bars 34*a*–*f* are elongated members transversely supported along base 28. Each of the expansion members includes at least one pair of perimeter posts 55 and a plurality of stretcher pins 57. A row of perimeter posts 55 are also provided near the edge of carriages 30 and 32.

Attached to transverse ends of carriage 30, carriage 32, and expansion bars 34*a*–*f* are a number of side posts 56. Engaged with the side posts are four links 58, 60, 62, and 64, each being provided with a number of holes receptive to one or more of the side posts. Side posts 56 and links 58 are used to couple the carriages to selective expansion bars 34*a*–*f*.

Figure 5:
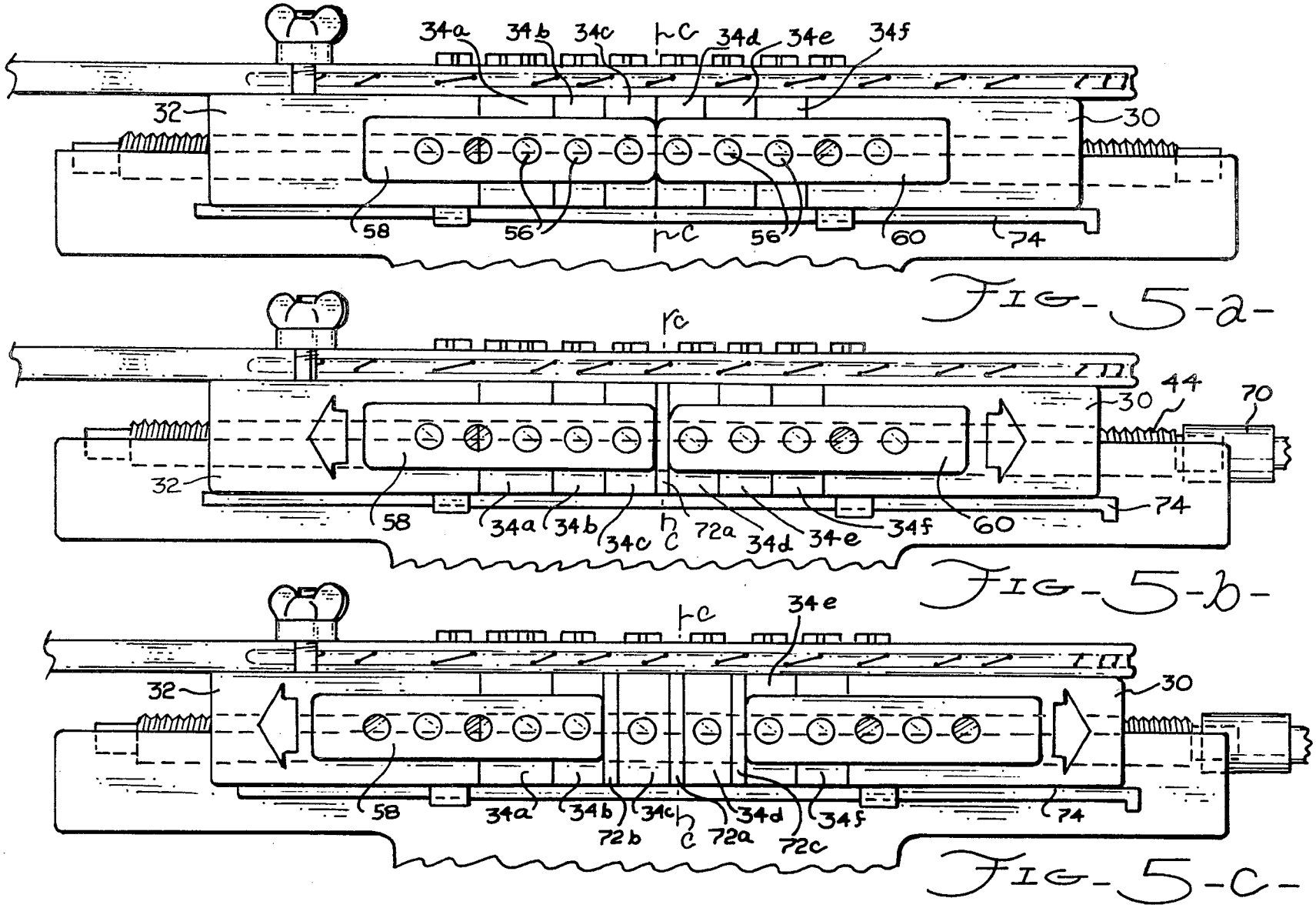
FIG. 5*a* is an elevational view taken along line 5A—5A of FIG. 2.
FIGS. 5*b* and 5*c* are the elevational views of FIG. 5*a* illustrating the expansion of the pre-strung web.

The operation and method of this invention will be described with reference to FIGS. 1–6 but with particular reference to FIGS. 5*a*–5*c*. As a first step, a linearly expansible web 10 is constructed, such as on a peb board 16. The web is then transferred to a web stretching machine such as the one exemplified herein. A web carrier 18 may be conveniently used for such a transfer. The posts 20 of the web carrier are preferably aligned with the perimeter posts 55 of the web stretching machine 26 to permit a pre-strung web to slide directly off of the posts 20 and onto the posts 55.

As seen in FIG. 2, posts 55 engage the interstices along the perimeter of the web, and apexes 14 of many of the internal interstices of the web abut stretcher pins 57. It will also be noted that web 10 is symmetrical around a transverse axis "C". This symmetry is to allow the web to be expanded row-by-row starting with the innermost rows and proceeding outwardly to the outermost rows.

With the racquet head 36 firmly clamped to carriage 32 by clamp assembly 40, end strings 66 and 68 of the web are firmly attached to racquet head 36. With reference to FIGS. 5a–5c, prior to stretching, links 58 and 62 are attached to side posts 56 of expansion bars 34a–34c (located to one side of the central axis "C"), and links 60 and 62 are attached to side posts 66 of expansion bars 34d–34f (located to the other side o the central axis "C"). Thus, expansion bars 34a–34c move with carriage 32 and carriage 34d–34f move with expansion bars 30.

Referring to FIG. 5b, torque is applied to screw 44 such as by a socket wrench 70 to cause carriages 30 and 32 to move in opposite directions. As the carriages move apart, so do the expansion bars. Since expansion bars 34a–34c move together in one direction, and expansion bars 34d–34f move together in the opposite direction, the stretcher pins 57 of expansion bars 34c and 34d separate, causing the central row of interstices of the web to expand along their longitudinal axis. This applies a tensioning force to the web commencing with the central rows.

Of course, there are many ways to apply force to the carriages to cause them to move apart. For example, hydraulics, pneumatics, and a variety of mechanical devices such as cams, wedges, and levers could be used alternatively or additionally to the screw 44 mentioned above.

After the central row of interstices are expanded, a spacer 72a is placed between expansion bars 34c and 34d to prevent them from moving towards each other as expansion pressure is removed. A removable spacer retainer bar prevents spacer 72a from falling down between expansion bars 34c and 34d. Links 58–64 are then moved outwardly from the central axis C as shown in FIG. 5c.

With links in the position shown in FIG. 5c, links 58 and 62 are engaged with the side posts of expansion bars 34a and 34b, and links 60 and 64 are engaged with the side posts of expansion bars 34e and 34f. In this position, expansion bars 34a and 34b move with carriage 32, and expansion bars 34e and 34f move with carriage 30. Expansion bars 34c and 34d do not move with the carriages.

Once again, torque is incrementally applied to screw 44 to cause the carriages to separate. With the links attached as shown in FIG. 5c, there will be an expansion force between expansion bars 34b and 34c, and another expansion force between expansion bars 34e and 34f. These expansion forces stretch a pair of rows of the web symmetrically around the central axis C. After the rows are expanded a spacer 72b is placed between expansion bars 34b and 34c, and a spacer 72c is placed between expansion bars 34d and 34e. The links are then removed and the process continued until the web is fully expanded.

It will be noted that the process and apparatus of this invention stretches a pre-strung web from its center to its edges. This allows a constant tension to be applied to the web resulting in a more uniform string surface. While in the preferred embodiment of this invention the web is only stretched along one linear axis corresponding to the major axis of the racquet head, it is also possible to stretch the web along a linear axis corresponding to the minor axis of the racquet head. Of course, tension created along one axis will automatically create tension along the other. Furthermore, the web can be stretched along both of its axes such that the web is expanded both in the direction of the racquet head's major and minor axis.

Figure 6:
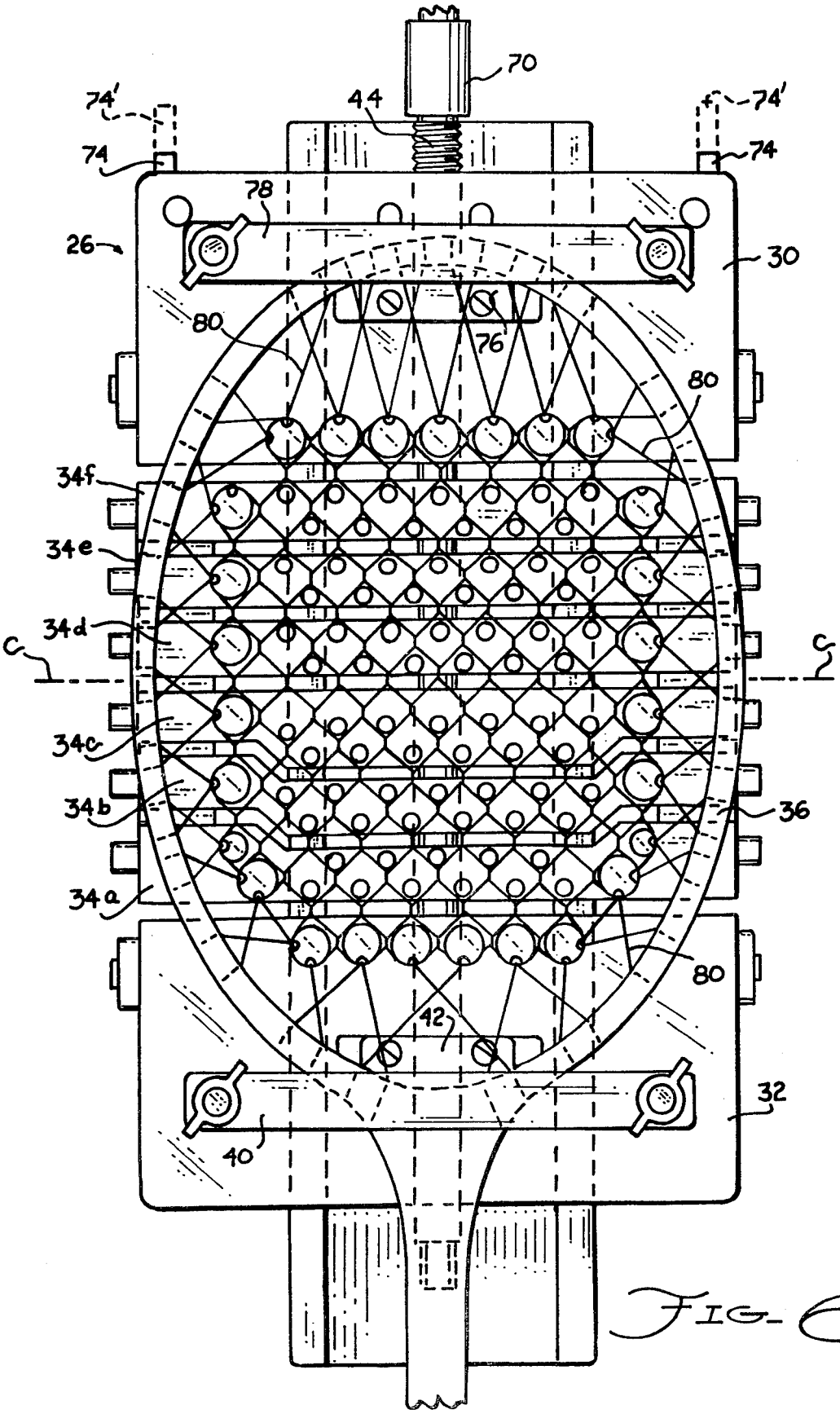
FIG. 6 is a top plan view of a fully stretched web being attached to a racquet.

Referring to FIG. 6, web 10 has been fully expanded, row-by-row from its central axis outward. The expansion has elongated the web 10 to a shape much more in conformance with the shape of racquet head 36.

After the final expansion, a stop member 76 is abuted with the inside of racquet head 36, and a clamping assembly 78 is clamped down over the head of the racquet. The stretched web is then attached to the racquet head 36 by lacing strings 80, or attached to hooks provided around the inner perimeter of the racquet head. Once the web is attached to the racquet, clamps 40 and 78 are released. The spacers 72 are removed by pulling out spacer retainer bars 74 as suggested at 74'. Socket wrench 70 is applied to screw 44 to release tension on the strings, and then the racquet is removed. Since the tensioned web is tied by string 30 to the racquet head, its removal from posts 55 and pins 57 allows the tension to spread evenly over the entire web.

To summarize the method of this invention, a pre-strung web having a linear axis of expansion and central axis substantially perpendicular to the axis of expansion is prepared. The web has a number of interlocking, parallel, zig-zag rows chain linked together to form diamond shaped interstices. The zig-zag rows are then successively spread apart beginning with the zig-zag rows most proximate the central axis and proceeding outwardly to the zig-zag rows most distal from said central axis. As a final step, the tensioned web is attached to the head of the racquet.

While this invention has been described in terms of a few preferred embodiments it is contemplated that persons reading the preceding descriptions and studying the drawing will realize various alterations, permutations and modifications thereof. It is therefore intended that the following appended claims be interpreted as including all such alterations, permutations and modifications as fall within the true spirit and scope of the present invention.

What is claimed is:

1. An apparatus for stringing a racquet with a pre-strung web having a linear axis of expansion and a plurality of diamond shaped intersticies having longitudinal axes parallel to said linear axis of expansion, said apparatus comprising:

(a) a base;

(b) a first carriage supported by said base for linear movement;

(c) means for incrementally moving said first carriage linearly along said base;

(d) a plurality of expansion bars supported by said base for collinear movement relative said first carriage, each of said expansion bars being provided with a plurality of upwardly extending pins adapted to engage apexes of said diamond shaped intersticies; and (e) means coupling selective ones of said expansion bars to said first carriage such that said pre-strung web may be stretched by moving said first carriage along said base.

2. An apparatus as claimed in claim 1 further comprising a second carriage supported by said base for collinear movement relative said first carriage, and wherein said means for incrementally moving said first carriage also moves said second carriage in a different, linear direction.

3. An apparatus as claimed in claim 2 wherein said means for incrementally moving said first carriage and said second carriage includes: an elongated shaft at least partially threaded from both ends, a first end of said shaft engaging a threaded bore provided in said first carriage and a second end of said shaft engaging threaded bores provided in second carriage.

4. An apparatus as claimed in claim 2 further comprising guide means for guiding said first carriage, said second carriage, and said expansion bars along a common linear axis.

5. An apparatus as claimed in claim 2 comprising linking means adapted to selectively couple an expansion bar to one of said first carriage and said second carriage.

6. An apparatus as claimed in claim 5 further comprising a spacer support bar coupled to said base and adapted to support said spacers.

7. An apparatus as claimed in claim 2 further comprising spacer means adapted for placement between adjoining expansion bars to prevent said adjoining expansion bars from moving towards one another.

* * * * *